US006181222B1

(12) United States Patent
Seewig et al.

(10) Patent No.: US 6,181,222 B1
(45) Date of Patent: Jan. 30, 2001

(54) POLARIZER FOR TWO DIFFERENT FREQUENCY BANDS

(75) Inventors: Udo Seewig, Langenhagen; Reimer Nagel, Hannover; Daniel Wojtkowiak, Neustadt, all of (DE)

(73) Assignee: Alcatel, Paris (FR)

( * ) Notice: Under 35 U.S.C. 154(b), the term of this patent shall be extended for 0 days.

(21) Appl. No.: 09/130,429

(22) Filed: Aug. 6, 1998

(30) Foreign Application Priority Data

Aug. 12, 1997 (DE) ..... 197 34 854

(51) Int. Cl.[7] ..... H01P 1/161; H01P 1/213

(52) U.S. Cl. ..... 333/126; 333/135; 333/21 A; 343/756

(58) Field of Search ..... 333/126, 129, 333/135, 137, 21 A; 343/756

(56) References Cited

U.S. PATENT DOCUMENTS

| | | | |
|---|---|---|---|
| 3,274,604 | | 9/1966 | Lewis . |
| 4,047,128 | * | 9/1977 | Morz ..... 333/21 A X |
| 4,467,294 | | 8/1984 | Janky et al. . |
| 4,837,531 | | 6/1989 | Gourlain et al. . |

FOREIGN PATENT DOCUMENTS

| | | |
|---|---|---|
| 0 096 461 B1 | 11/1990 | (EP) . |
| 2 518 822 | 6/1983 | (FR) . |
| 2 117 980 A1 | 10/1983 | (GB) . |
| 2 188 493 | 9/1987 | (GB) . |
| 59-131201 | 7/1984 | (JP) . |

OTHER PUBLICATIONS

DAS, B.N. ET AL: "A Rigorous Variational Formulation of an H Plane Slot–Coupled Tee Junction", IEEE Transactions on Microwave Theory and Techniques, 38 (1990) Jan. #1, N.Y..

MA, Z. ET AL: "Efficient Characterization of Complex H–Plane Waveguide PI–Junction and Cross–Junctions", IEICE Transactions on Electronics, Vol. E79–C, No. 3, Mar. 1996.

Boifot, Anton, M.: "Classification of Ortho–Mode Transducers", European Transactions on Telecommunications and Related Technologies, , vol. 2, N. 5, Sep. 1, 1991, pp. 35–42, XP000266379.

* cited by examiner

*Primary Examiner*—Benny Lee
(74) *Attorney, Agent, or Firm*—Ware, Fressola, Van der Sluys & Adolphson LLP

(57) ABSTRACT

A polarizer for two different frequency bands is described for exciting an antenna with a parabolic reflector. The polarizer has a waveguide section capable of carrying in each frequency band two mutually perpendicularly linearly polarized waves. For each frequency band, two waveguides having a rectangular cross-section are connected to the waveguide section separate from each other and mutually offset in the axial direction of the waveguide section. A respective waveguide is connected directly to the waveguide section for each polarization direction of the lower frequency band, whereas for the upper frequency band—from a connecting point (11, 12) on—each of the two waveguides is subdivided into two branches (18, 19, 20, 21) with each having identical rectangular cross-section. The respective branches terminate on the waveguide section at mutually opposing locations which are circumferentially offset relative to each other by 90° for the two polarization directions. To simplify the portion designated for the upper frequency band, the wider flat sides of the two branches (18, 19, 20, 21) abut each other at each of the connecting points (11, 12) in such a way that the front faces of the branches are aligned with each other for connection to the respective waveguide (7, 8). In addition, one of the branches (19, 21) of the two different polarization directions is twisted along its path about an angle of 180°.

3 Claims, 1 Drawing Sheet

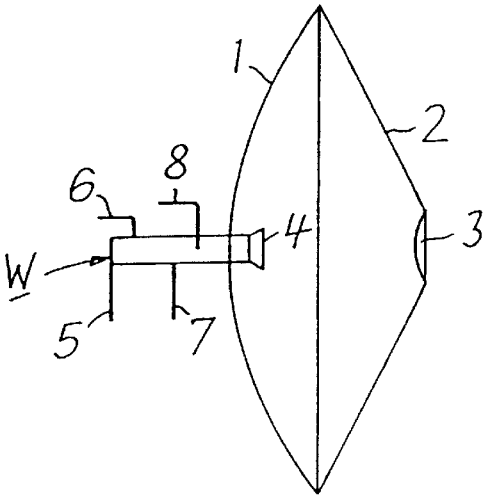
Fig. 1
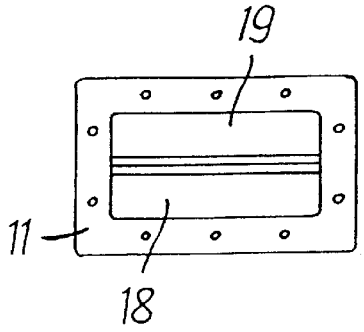
Fig. 3
Fig. 2
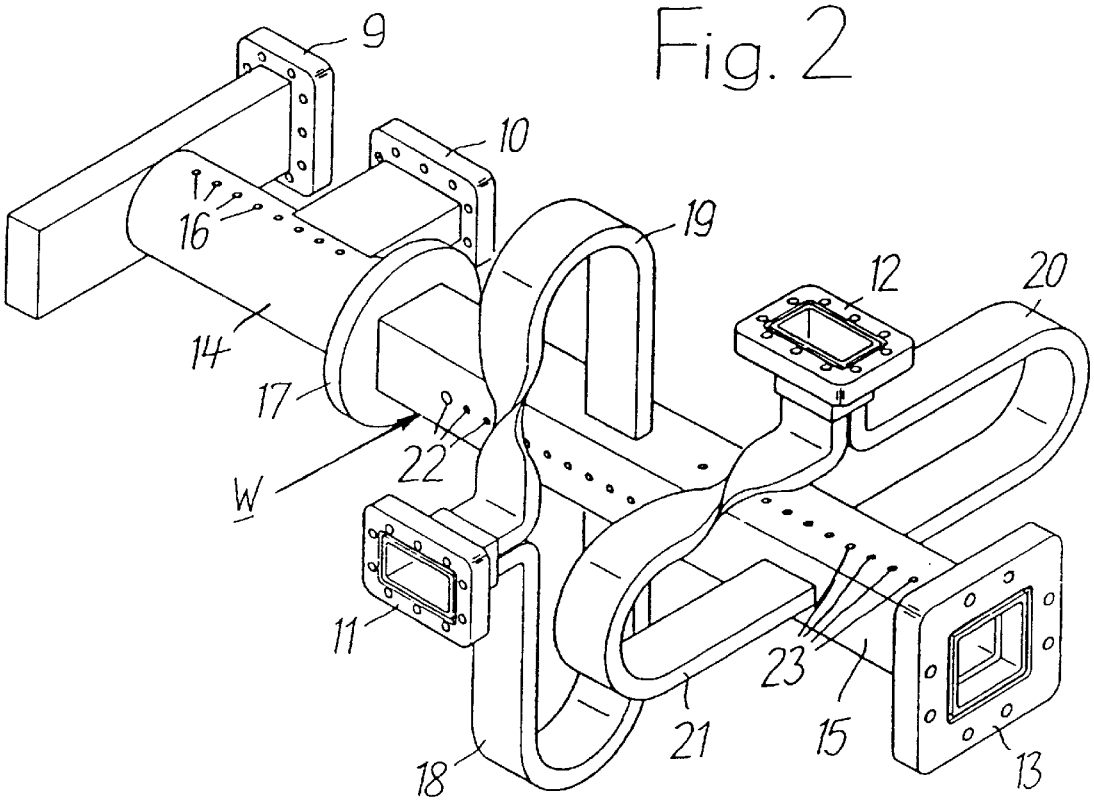

POLARIZER FOR TWO DIFFERENT FREQUENCY BANDS

BACKGROUND OF THE INVENTION

1. Technical Field

The invention relates to a polarizer for two different frequency bands for exciting an antenna with a parabolic reflector, comprising a waveguide section capable of carrying in each frequency band two mutually perpendicularly linearly polarized waves, wherein for each frequency band there are connected to the waveguide section separate from each other and mutually offset in the axial direction of the waveguide section two waveguides having a rectangular cross-section, wherein for the lower frequency band for each polarization direction a respective waveguide is connected directly to the waveguide section, wherein for the higher frequency band—starting at a connecting point—each of the two waveguides is subdivided into two branches with identical rectangular cross-sections, with the branches terminating at two opposing locations of the waveguide section, and wherein the locations where the branches for the two different polarization directions terminate on the waveguide section, are circumferentially offset relative to each other by 90°.

2. Description of the Prior Art

Polarizers are used, for example, for exciting antennae with a parabolic reflector for line of sight radio communication, satellite communication or radio location. Polarizers can be used for either exciting the reflector through a sub-reflector (for example, Cassegrain principle) or for directly illuminating the reflector. In the following, "excitation" shall denote both transmission directions of the electromagnetic waves, i.e. transmitted as well as received waves. In polarizers of this type, two linearly polarized electromagnetic waves of the same frequency band are guided so that their polarization directions are orthogonal to each other. The two waves therefore do not interfere. Polarizers for a single frequency band or for two different frequency bands are known in the art.

GB 2,117,980 A1 describes a polarizer for two different frequency bands. The polarizer has two regions with circular cross-sections which are the arranged one after the other and have different inside diameters. Two waveguides are connected to each of these regions. Moreover, the region with the larger inside diameter has two different inside diameters wherein the two waveguides of this region terminate in areas having different inside diameters. This polarizer is very expensive to manufacture because the two differently sized regions have to be combined individually while observing very tight tolerances.

In the known polarizer described in EP 0 096 461 B1, the waveguides for the higher frequency band are subdivided, starting at a connection point, into two branches which are terminated in the waveguide section at diametrically opposed points. The connection point is formed as a T-shaped hybrid coupler and provided with two connections. In normal operation, the respective waveguide is coupled in phase via one of the connections which is coupled via a waveguide section to the hybrid coupler. The other connection which is not in phase, is covered with a short-circuit plate. The construction of the polarizer is very costly, in particular in the region adapted for the higher frequency band, which requires the two hybrid couplers with the connected waveguide and two additional connections which have to be covered, for example, by short circuit plates. These components also add to the weight, making the installation of the polarizer on the reflector of an antenna more difficult.

SUMMARY OF THE INVENTION

It is the object of the present invention to simplify the construction of the polarizer described above.

The object is achieved by the invention in that at each of the connecting points, the wider flat sides of the two branches abut each other in such a way that the front faces of the branches are aligned with each other and adapted for connection to the respective waveguide and that each of the branches of the two different polarization directions is twisted along its path about an angle of 180°.

The polarizer is of simple construction not only in the region provided for the lower frequency band, but also in the region provided for the upper frequency band . Each waveguide has only one connection for each polarization direction which at the same time operates as a connection point. Both branches are directly connected to this connection point which also functions as a power splitter. One of the branches is twisted about 180° along its path. No additional components or materials are therefore required to conveniently feed the waves which are divided at the connection point into the waveguide section with the same phase so that the waves are added together interference-free. Consequently, the weight of the polarizer is quite small.

The invention will be fully understood when reference is made to the following detailed description taken in conjunction with the accompanying drawing.

BRIEF DESCRIPTION OF THE DRAWING

FIG. 1 is a schematic side view of an antenna with sub-reflector and polarizer, FIG. 2 is an enlarged perspective view of the polarizer of the invention, and FIG. 3 is an enlarged top view of a connection point of the polarizer of FIG. 2.

DETAILED DESCRIPTION OF THE INVENTION

The polarizer of the present invention can be used both for waves to be radiated from an antenna and also for waves to be received by the antenna. The polarizer is capable of separately guiding, for example, waves in the frequency band 3.6 to 4.2 GHz and in the frequency band 6.425 to 7.125 GHz. Of the two different frequency bands, the band with the lower frequencies will hereinafter be referred to as "lower band" and the band with the higher frequencies as "upper band". FIG. 1 depicts an antenna with a sub-reflector. However, the polarizer W can also be used for directly exciting an antenna.

Referring to FIG. 1,the parabolic reflector of an antenna has the reference numeral 1. A sub-reflector 3 is connected to the parabolic reflector 1 via retaining members 2. A polarizer W which is formed as a waveguide section is attached in the center of the reflector 1. A feed horn 4 is attached to the waveguide section on the side facing the reflector 1. Also connected to the waveguide section are four waveguides 5, 6, 7 and 8 as shown in FIG. 1. The installation and arrangement of the components of the antenna are known in the art and will not be described in detail.

The waveguides 5 and 6 are designed for the lower band, whereas the waves of the upper band are guided in the waveguides 7 and 8. As shown in FIG. 2, the four waveguides 5 to 8 have a rectangular cross-section and are omitted from FIG. 2 for sake of clarity. The polarizer W is provided with four flanges 9, 10, 11 and 12, each of which is connected a respective waveguide 5 to 8. The feed horn 4 (FIG. 1) can be attached to flange 13.

The polarizer W has a region 14 for the lower band and a region 15 for the upper band. In the illustrated embodiment, the region 14 has the form of a circular waveguide. The front face of waveguide 5 is connected to the polarizer W via the flange 9, whereas the waveguide 6 is terminated radially in the region 14 by flange 10. Indicated in the form of circles 16 are short circuit and tuning elements which are required for interference-free propagation of the orthogonally polarized waves in the polarizer W.

In the illustrated embodiment, the region 15 has a square cross-section. A transition 17 with a lower reflectivity is disposed between the regions 14 and 15 of the polarizer W. The waveguide 7 is connected to the region 15 via the flange 11, while the waveguide 8 is connected to the region 15 via the flange 12. It should be appreciated by those skilled in the art that the region 15 of the polarizer W can be formed as a circular waveguide similar to region 14. The polarizer W could then be formed as a one-piece circular waveguide.

Since the waves of the lower band have to be guided also in the region 15 of the polarizer W, the region 15 has correspondingly large inside dimensions. The waves of the upper band therefore require a symmetric termination to prevent excitation of higher modes. From the connection point for the waveguide 7 formed by the flange 11, there extend two branches 18 and 19 which terminate in the region 15 of the polarizer W at two diametrically opposed points. The branches 18 and 19 are formed as rectangular waveguides and have the same dimensions and therefore also the same cross-section. The branch 19 is twisted about an angle of 180° along its path.

The large flat sides of the branches 18 and 19 directly abut each other at their free ends. The front ends which extend into the flange 11, are aligned with each other. The waveguide 7 is then directly connected to the branches 18 and 19. The power of the waves supplied via the waveguide 7 is subdivided inside the flange 11 into two partial waves of equal strength which are guided onward in the branches 18 and 19 with the same power and are fed into the region 15 of the polarizer W with the same phase because the branch 19 is twisted by 180°. The two partial waves are then added in region 15. The two branches 18 and 19 operate in a similar fashion for the other transmission direction.

The branches 18 and 19 are constructed as flat waveguides. In a preferred embodiment, they have the same width as the waveguide 7 which is connected to flange 11, but only half the height of waveguide 7. The end faces of the two branches 18 and 19 are aligned, with the flat sides of the branches abutting each other. A top view of the flange 11 and the brandches 18 and 19 is shown in FIG. 3. The illustration can be expected to look different if the branches 18 and 19 had different, in particular larger dimensions. The branches 18 and 19 can then also be constructed as flat waveguides having the dimensions of waveguide 7. However, in this case, the transition section between the waveguide 7 and the branches 18 and 19 has to be adapted so as not to generate reflections. In all embodiments, conventional capacitive and inductive tuning elements can be arranged in the section of flange 11.

The two branches 20 and 21 extend from flange 12 to which waveguide 8 is connected. The branch 21 is twisted along its path about an angle of 180°. The branches 20 and 21 are terminated in the region 15 of the polarizer W at two diametrically opposed points. These points are offset relative to the points where the branches 18 and 19 terminate in the region 15, both circumferentially by 90° and along the axis of polarizer W. The branches 20 and 21 operate and are arranged in flange 12 in the same manner as the branches 18 and 19.

Again, tuning elements for an interference-free propagation of the waves are indicated as circles 22 and 23.

The preferred embodiment described above admirably achieves the objects of the invention. However, it will be appreciated that departures can be made by those skilled in the art without departing from the spirit and scope of the invention which is limited only by the following claims.

What is claimed is:

1. Polarizer for both a lower frequency band and an upper frequency band for exciting an antenna with a parabolic reflector, comprising:

(a) waveguide section for carrying two mutually perpendicularly linearly polarized waves for each of the upper and lower frequency bands, (b) means for connecting the waveguide section to two waveguides for the lower frequency band, the two lower frequency band waveguides being connected to the waveguide section separate from each other and mutually offset in an axial direction of the waveguide section;

(c) means for connecting the waveguide section to two waveguides for the upper frequency band, the two upper frequency band waveguides being connected to the waveguide section separate from each other and mutually offset in the axial direction of the waveguide section, said connecting means for the two upper frequency band waveguides subdividing each of the two upper frequency waveguides into two branches with identical rectangular cross-sections, the respective branches for each of the two upper frequency band waveguides terminating at two diametrically opposing locations on the waveguide section, the respective branches for one of the two upper frequency band waveguides terminate on the waveguide section circumferentially offset by 90° relative to the respective branches of the other of the two upper frequency band waveguides, the respective branches for each of the two upper frequency band waveguides have wider flat sides which abut each other in such a way that front faces of the respective branches which abut are aligned with each other for connection to the respective upper frequency band waveguide, and one of the respective branches for each of the two upper frequency band waveguides is twisted about an angle of 180°.

2. Polarizer according to claim 1, wherein at least a region of the waveguide section has a circular crosssection.

3. Polarizer according to claim 1, wherein the waveguide section has a lower frequency band region with circular cross-section, the waveguide section has a upper frequency band region with a square cross-section and a low reflectivity transition between the lower frequency band region and the upper frequency band region.

* * * * *

UNITED STATES PATENT AND TRADEMARK OFFICE

CERTIFICATE OF CORRECTION

PATENT NO. : 6,181,222
DATED : January 30, 2001
INVENTOR(S) : Udo Seewig et al.

It is certified that error appears in the above-identified patent and that said Letters Patent is hereby corrected as shown below:

On the cover page of the patent, under "References Cited - U.S. PATENT DOCUMENTS" - add the following:

-- 4,956,662 9/1990 de Ronde --.

In column 4, line 54, claim 2, line 2, "crosssection" should be -- cross-section --.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*